US007004459B2

(12) United States Patent
Sato et al.

(10) Patent No.: US 7,004,459 B2
(45) Date of Patent: Feb. 28, 2006

(54) CLAMPING DEVICE

(75) Inventors: Toshio Sato, Tsukuba-gun (JP); Akira Tadano, Tsukuba-gun (JP)

(73) Assignee: SMC Corporation, Tokyo (JP)

( * ) Notice: Subject to any disclaimer, the term of this patent is extended or adjusted under 35 U.S.C. 154(b) by 135 days.

(21) Appl. No.: 10/680,113

(22) Filed: Oct. 8, 2003

(65) Prior Publication Data

US 2004/0075207 A1 Apr. 22, 2004

(30) Foreign Application Priority Data

Oct. 22, 2002 (JP) ..... 2002-307532

(51) Int. Cl.
*B25B 1/06* (2006.01)

(52) U.S. Cl. ..... 269/221; 269/216; 269/226

(58) Field of Classification Search ..... 269/221, 269/222, 228, 32, 216
See application file for complete search history.

(56) References Cited

U.S. PATENT DOCUMENTS 4,635,911 A * 1/1987 Lovrenich ..... 269/93

* cited by examiner

*Primary Examiner*—Robert C. Watson
(74) *Attorney, Agent, or Firm*—Oblon, Spivak, McClelland, Maier & Neustadt, P.C.

(57) ABSTRACT

A clamping device includes a first clamping arm and a second clamping arm, an arm driving portion for displacing the first clamping arm to a clamping position and a non-clamping position, and a clamping force applying portion for applying a required clamping force to the clamping arm. The arm driving portion has a first driving source for displacing the first clamping arm and a power transmission mechanism. The clamping force applying portion has a pressing member for applying the clamping force to the first clamping arm by applying a rotating force in a clamping direction to the rotary shaft and a second driving source for displacing the pressing member from a non-operating position to an operating position for applying the clamping force.

13 Claims, 6 Drawing Sheets

(a)

(b)

CLAMPING DEVICE

TECHNICAL FIELD

The present invention relates to a clamping device for clamping a workpiece for a purpose of processing and the like.

BACKGROUND ART

In an automatic assembly line or the like in the automobile industry, a clamping device for clamping a workpiece for a purpose of processing is frequently used. As such a clamping device, there are already-known devices as disclosed in Japanese Patent Application Laid-open No. 2001-105332, Japanese Patent Application Laid-open No. 2001-310225, Japanese Patent Application Laid-open No. 2001-009741, and the like, for example.

In this clamping device, a first clamping arm is rotated and moved to a clamping position and then a large clamping force for clamping is generated. In this case, the first clamping arm is substantially at no load while moving to the clamping position and therefore a large driving force is not required from a driving source. On the other hand, in a stage of generating the clamping force, the large driving force is required from the driving source.

However, in the conventionally-known clamping device, a common driving source is used as a driving source for rotating and moving the first clamping arm to the clamping position and a driving source for generating a final clamping force. Therefore, if performance of the driving source itself is large enough to generate the clamping force, the performance is too large for rotation of the first clamping arm and also a driving system of the first clamping arm is required to have a strength adapted to the performance of the driving source. If a degree of the performance of the driving source is adapted to a rotating force of the first clamping arm on the contrary, it is difficult to generate a required clamping force.

DISCLOSURE OF THE INVENTION

It is a technical object of the present invention to provide a simple clamping device by which both of a proper driving force for rotating and moving a clamping arm to a clamping position and a proper driving force for generating a final clamping force can be obtained by solving the above problems and sufficiently considering a natural characteristic of a driving force of a clamping device.

It is another technical object of the invention to provide a clamping device in which a driving system for rotating and moving the clamping arm to the clamping position and a driving system for generating the final clamping force can be formed to have strengths adapted to their driving forces by obtaining the proper driving forces.

It is another technical object of the invention to provide a clamping device which operates smoothly as a whole.

It is another technical object of the invention to provide a clamping device in which the final clamping force can properly be adjusted or can be made substantially constant irrespective of thickness variations in a workpiece with a simple structure.

To achieve the above objects, according to the invention, there is provided a clamping device comprising a first clamping arm and a second clamping arm mounted for opening and closing to a body, an arm driving portion for displacing the first clamping arm to a clamping position and a non-clamping position, and a clamping force applying portion for applying a required clamping force to the clamping arm.

The arm driving portion includes a first driving source for displacing the first clamping arm and a power transmission mechanism for transmitting a driving force from the first driving source to a rotary shaft of the first clamping arm. The clamping force applying portion includes a pressing member for applying the clamping force to the first clamping arm by applying a rotating force in a clamping direction to the rotary shaft and a second driving source for displacing the pressing member from a non-operating position to an operating position for applying the clamping force.

In a concrete embodiment of the invention, the rotary shaft of the first clamping arm has a clamping force transmitting lever and the pressing member presses the transmitting lever to thereby apply the rotating force in the clamping direction to the rotary shaft.

In a preferred embodiment of the invention, a spring force of a clamping spring is applied to the pressing member and the clamping force can be obtained by the spring force.

In this case, it is preferable that a proximal end portion of the pressing member is rotatably mounted to a bracket, that the bracket is mounted to the body via the clamping spring, and that the spring force of the clamping spring is adjustable.

The clamping spring may be formed of a disc spring. The disc spring has a region in which the spring force is substantially constant with respect to flexure variation in a characteristic curve and the spring force in the region is applied as the clamping force.

The second driving source may be formed of an electromagnet. The electromagnet has an exciting coil and a core and the pressing member is displaced to the operating position by an electromagnetic attracting force generated in the core by energization of the exciting coil.

According to a concrete embodiment of the invention, the power transmission mechanism and the rotary shaft are connected to each other with play of a certain angle maintained therebetween. The power transmission mechanism has a clamp releasing lever for causing the pressing member to recede from the operating position to the non-operating position. The clamp releasing lever rotates prior to the rotary shaft in a range of the play in releasing of clamping to thereby cause the pressing member to recede to the non-operating position where the pressing member is detached from the transmitting lever.

According to another concrete embodiment of the invention, the power transmission mechanism includes a worm shaft driven by the first driving source and a worm wheel disposed coaxially with the rotary shaft. The worm wheel has the clamp releasing lever and one or more recessed groove(s) in a hole face of a central hole in which the rotary shaft is fitted, (an) engaging projecting portion(s) provided to an outer periphery of the rotary shaft being fitted in the recessed groove(s). A groove width in a circumferential direction of each the recessed groove is formed to be larger than a width in the same direction of each the engaging projecting portion to thereby form the play.

In the invention, it is preferable that the pressing member has a rotatable roller in a position near a tip end of the member and is in contact with the transmitting lever at substantially right angles via the roller.

According to the invention, it is possible to obtain a simple clamping device by which both of the proper driving force for rotating and moving the clamping arm to the clamping position and the proper driving force for generating the final clamping force can be obtained. It is also possible to obtain a clamping device which can operate extremely smoothly as a whole by fusing the driving system (arm driving portion) for rotating and moving the first clamping arm to the clamping position and the driving system (clamping force applying portion) for generating the final clamping force into one with a simple structure.

BEST MODES FOR CARRYING OUT THE INVENTION

Figure 1:
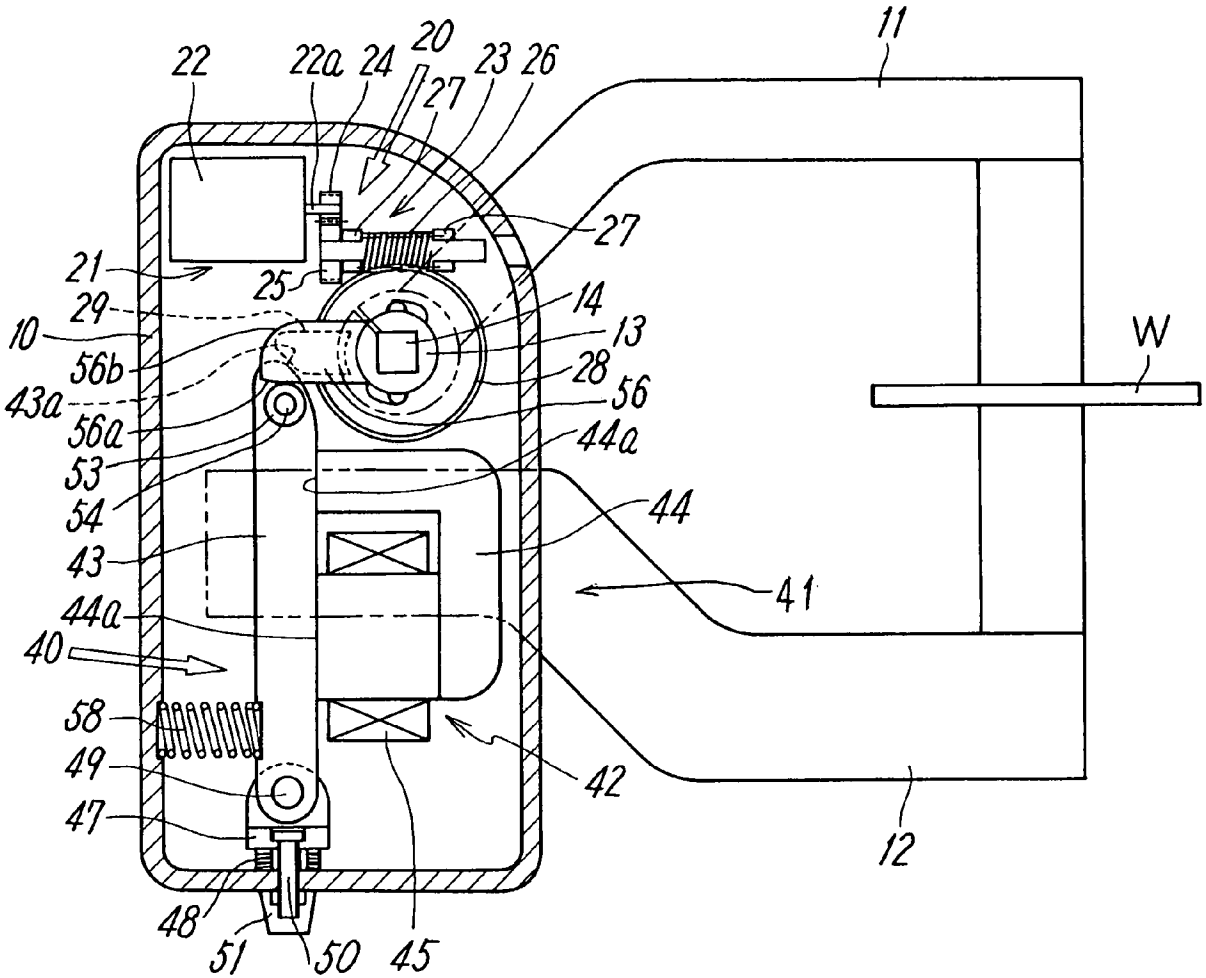
FIG. 1 is a sectional view of an embodiment of a clamping device according to the present invention.
Figure 2:
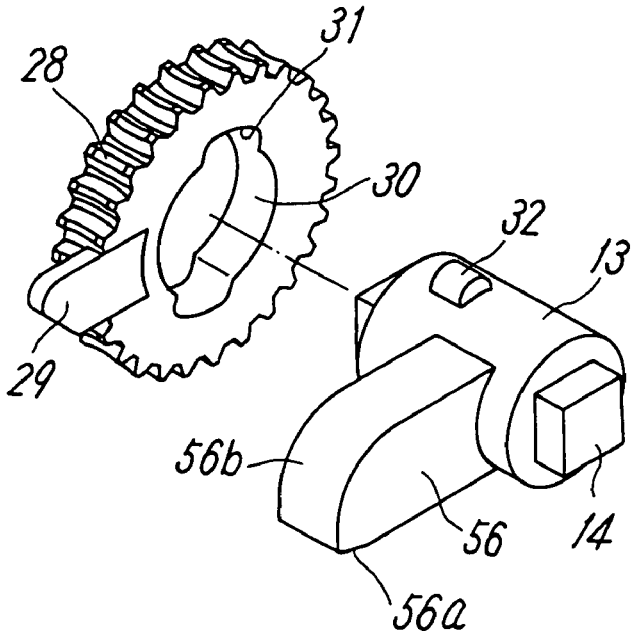
FIG. 2 is an exploded perspective view of a rotary shaft and a worm wheel of a first clamping arm in the embodiment.
Figure 3:
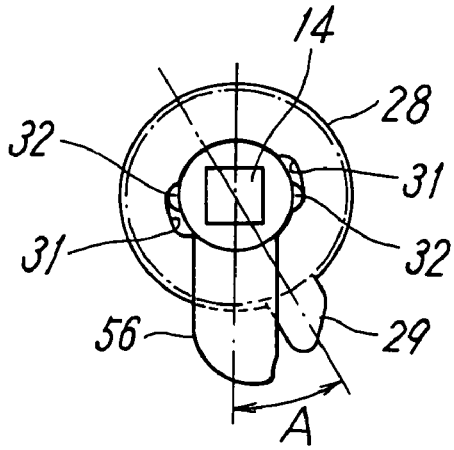
FIGS. 3*a* and 3*b* are explanatory views showing relative rotating ranges of the rotary shaft and the worm wheel of the first clamping arm in the embodiment.
Figure 3:
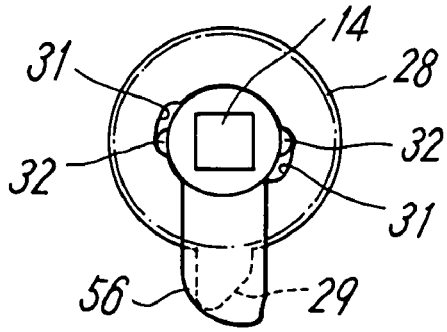

FIGS. 1 to 3 show an embodiment of an electric clamping device according to the present invention. The clamping device clamps a workpiece W between a first clamping arm 11 pivotally supported on a body 10 and a second clamping arm 12 fixed to the body 10. Components provided in the body 10 are broadly divided into an arm driving portion 20 for turning the first clamping arm 11 to a clamping position and a clamping force applying portion 40 for applying a clamping force to the first clamping arm 11 which has turned to the clamping position. The first clamping arm 11 is detachably mounted to an angular shaft portion 14 at an outer end of a rotary shaft 13 rotatably supported on the body 10.

The arm driving portion 20 has a first driving source 21 for turning the first clamping arm 11. The first driving source 21 is formed of an electric motor 22. The electric motor 22 is connected to the rotary shaft 13 of the first clamping arm 11 via a power transmission mechanism 23 and rotation from the electric motor 22 is transmitted to the rotary shaft 13 via the power transmission mechanism 23.

The power transmission mechanism 23 transmits rotation to a worm shaft 26 supported on bearings 27 via a gear 24 provided on a driving shaft 22*a* of the motor 22 and a gear 25 engaged with the gear 24 and transmits rotation from the worm shaft 26 to a worm wheel 28 provided onto the rotary shaft 13 of the first clamping arm 11. Because a driving system (arm driving portion) 20 for transmitting rotation to the rotary shaft 13 via the power transmission mechanism 23 only rotates the first clamping arm 11 without a load, performance of the motor 22, which is a driving source, may be low to such a degree as to be adaptable to this rotation and respective portions of the driving system (arm driving portion 20) from the motor 22 to the worm wheel 28 may also have relatively small strength adapted to the performance.

The first driving source 21 is not limited to the electric motor 22 but may be an air-operated driving device and the like.

As is clearly shown in FIG. 2, the worm wheel 28 has a clamp releasing lever 29 projecting in a radial direction. The power transmission mechanism 23 has certain 'play' between the rotary shaft 13 and itself. In other words, at portions of a central hole 30 of the worm wheel 28 in which the rotary shaft 13 of the first clamping arm 11 is fitted, a pair of recessed grooves 31, 31 in which a pair of engaging projecting portions 32, 32 projecting from a periphery of the rotary shaft 13 are fitted are provided in positions symmetric with respect to a center of the central hole 30. Groove widths of these recessed grooves 31, 31 in a direction along a circumference of the central hole 30 are greater than widths of the engaging projecting portions 32, 32 in the same direction as shown in FIGS. 3(*a*) and 3(*b*). Therefore, the engaging projecting portions 32, 32 can be displaced in a range of a certain angle A in the recessed grooves 31, 31. Therefore, rotation of the worm wheel 28 is transmitted to the rotary shaft 13 via the engaging projecting portion 32 when an inner wall of the recessed groove 31 and the engaging projecting portion 32 are locked to each other after exceeding the angle of the play.

Figure 10:
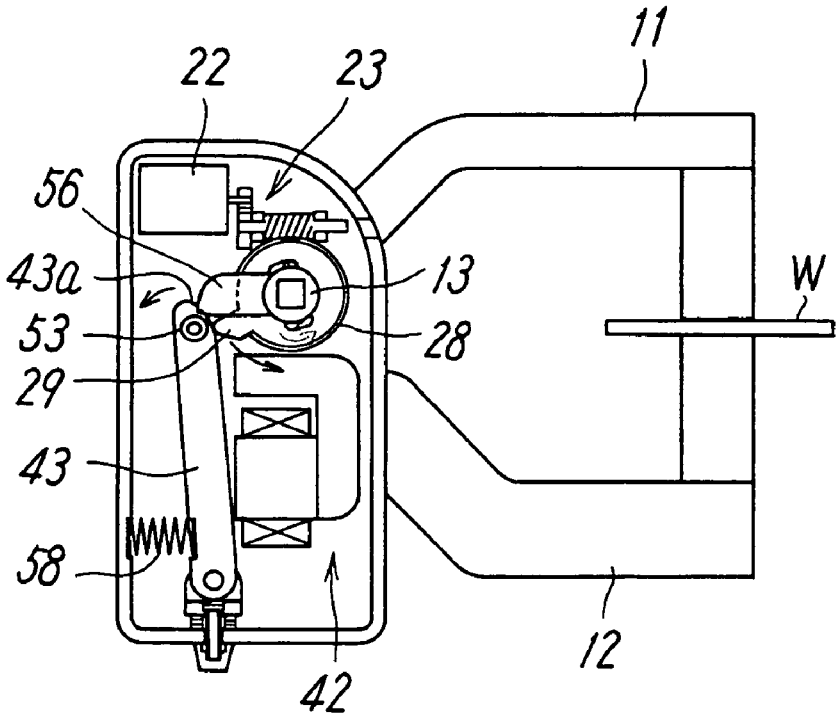
FIG. 10 is an operation explanatory view showing a state in which clamping of the workpiece by the first clamping arm is released in the embodiment.

The angle A is for enabling the clamp releasing lever 29 on the worm wheel 28 to move prior to a clamping force transmitting lever 56 on the rotary shaft 13 when the motor 22 is rotated reversely in clamp releasing which will be described later by using FIG. 10. Moreover, the play is sufficient to cause a pressing member 43 which has bumped into the clamping force transmitting lever 56 on the rotary shaft 13 and has been transmitting the clamping force to recede from a rotating range of the clamping force transmitting lever 56 by the prior rotation of the clamp releasing lever 29. As a result, the clamping force transmitting lever 56 can return to an initial position by reverse rotation of the motor 22.

On the other hand, the clamping force applying portion 40 has a second driving source 41 provided separately from the first driving source 21 to generate a clamping force. The second driving source 41 is formed of an electromagnetic driving device. To put it concretely, the second driving source 41 is formed of an electromagnet 42 capable of generating a large driving force with a small stroke. The electromagnet 42 attracts the pressing member 43 to an operating position shown in FIG. 1 after the first clamping arm 11 is turned to the clamping position by the arm driving portion 20 to apply the clamping force to the first clamping arm 11 via the rotary shaft 13 by the pressing member 43. More specifically, the electromagnet 42 includes a core 44 having an attracting face 44*a* facing a side face of the pressing member 43 and an exciting coil 45 wound to surround a portion of the core 44. At least a portion of the pressing member 43 to be attracted is formed of a ferromagnetic material.

The pressing member 43 is in a shape of a long and narrow lever and has a proximal end portion rotatably connected to a bracket 47 by a pin 49, the bracket 47 mounted to the body 10. The bracket 47 is mounted to the body 10 by an adjusting bolt 50 and an adjusting nut 51 with a clamping spring 48 disposed between the bracket 47 and the body 10. In the example shown in the drawings, the clamping spring 48 is formed of one or more disc spring(s) and the bracket 47 is mounted with the disc spring(s) compressed halfway. As a result, an initial compressive force of the disc spring(s) is acting on the pressing member 43 via the bracket 47. The adjusting bolt 50 and the adjusting nut 51 can be used not only for adjusting the initial compressive force of the clamping spring 48 but also for adjusting the clamping force when the clamping force has varied due to wear or the like of respective portions of the device.

In a position of the pressing member 43 near a tip end, a roller 53 is rotatably supported on a support shaft 54. The roller 53 is pushed into a lower portion of the transmitting lever 56 on the rotary shaft 13 as the pressing member 43 is attracted by the electromagnet 42 in clamping of the workpiece W between the clamping arms 11 and 12 and strongly pushes up the transmitting lever 56 to apply a rotating force in a clamping direction to the rotary shaft 13 to thereby apply the clamping force to the first clamping arm 11. When the pressing member 43 is attracted by the electromagnet 42 and is retained in the operating position (see FIGS. 1 and 9), the force of the clamping spring 48 is transmitted from the roller 53 to the rotary shaft 13 via the transmitting lever 56 and becomes the clamping force. Therefore, the clamping force applied to the workpiece W is stable and is of substantially constant strength. If there is thickness variations in the workpiece W, the variation is absorbed by deformation of the clamping spring 48. Therefore, when the electromagnet 42 is caused to operate, the pressing member 43 can always and reliably be attracted and driven to the operating position to be toggled on stably.

At a portion of a tip end side of the transmitting lever 56 with which the roller 53 is in contact, an inclined face 56*a* is provided. The inclined face 56*a* is for facilitating pushing of the roller 53 into the lower portion of the transmitting lever 56 when the electromagnet 42 is caused to operate to displace the pressing member 43 to the operating position and for applying strong clamping force to the transmitting lever 56 by a wedge effect. When the roller 53 is pushed into the lower portion of the transmitting lever 56, the pressing member 43 bumps into the transmitting lever 56 at substantially right angles to the transmitting lever 56 and is toggled on, the pressing member 43 is retained stably in the operating position.

On the other hand, an arc-shaped pressing face 56*b* is provided to the tip end of the transmitting lever 56. While the first clamping arm 11 moves from the initial position, i.e., a non-clamping position in FIG. 6 to the clamping position in FIGS. 1 and 9, the pressing face 56*b* comes in contact with the roller 53 of the pressing member 43 to perform a function of pushing the roller 53 back against a biasing force of an auxiliary spring 58 provided in a compressed state between the body 10 and the pressing member 43 to thereby allow the transmitting lever 56 to be displaced easily while getting over the roller 53.

A pressing face 43*a* is provided to the tip end of the pressing member 43 and is pressed by a tip end of the clamp releasing lever 29 which rotates with the worm wheel 28 in releasing the clamping force applied by the member 43. When the pressing face 43*a* is pressed by the tip end of the clamp releasing lever 29, the roller 53 on the member 43 gets out of the rotating range of the transmitting lever 56 and the transmitting lever 56 can rotate to return.

Although the auxiliary spring 58 for constantly pressing and retaining the pressing member 43 onto the electromagnet 42 side is provided between the pressing member 43 and the body 10, the auxiliary spring 58 does not have such a biasing force as to displace the pressing member 43 to the operating position.

In order to clamp the workpiece W with the large clamping force, the clamping force applying portion 40 having the above structure needs a structure of strength required for transmitting the clamping force unlike the arm driving portion 20.

The second driving source 41 is not limited to the electromagnetic driving device using electromagnetic attracting force like the electromagnet 42 but may be a pressure-fluid-operated driving device such as an air cylinder.

Figure 4:
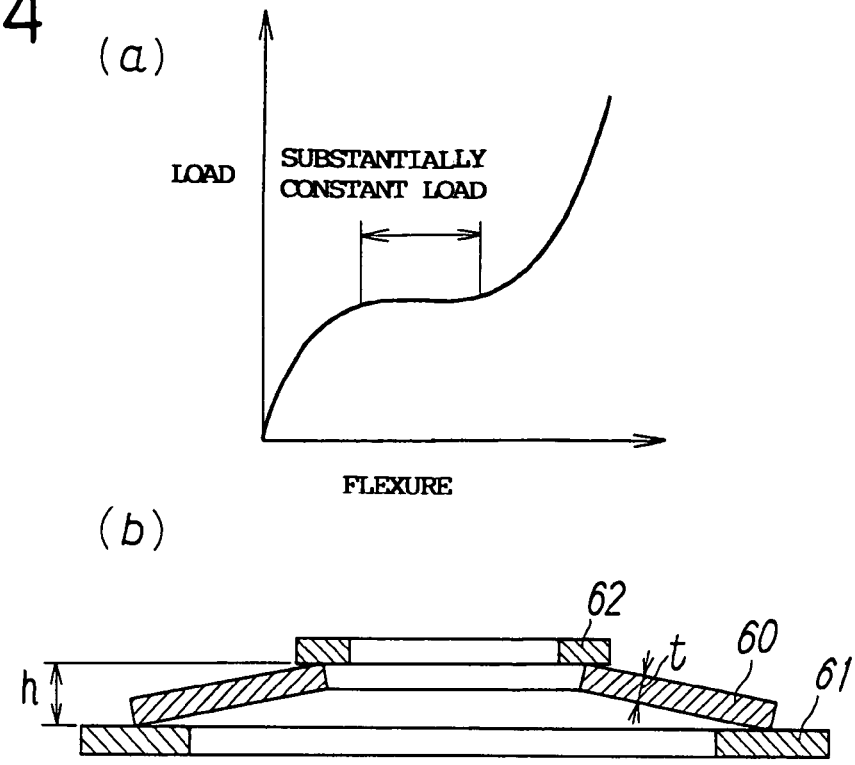
FIG. 4*a* is a graph showing a characteristic of a clamping spring used in the clamping device and FIG. 4*b* is a sectional view of a structure of the clamping spring showing the characteristic.

FIG. 4*a* shows a characteristic of the disc spring forming the clamping spring 48. This occurs when the disc spring 60 is sandwiched between support plates 61 and 62, a load is applied on the spring 60, and a relationship between an effective height h and a plate thickness t is about h/t=1.4 as shown in FIG. 4*b*. The disc spring has a region in which the load is substantially constant irrespective of variations in flexure on certain conditions. Therefore, if the clamping spring 48 is formed to meet such conditions, the clamping force can be made substantially constant even if there are thickness differences in the workpiece W or if the workpiece is deformed in clamping.

The load characteristic of the above-described disc spring can be adjusted in a wide range in general also by combining a plurality of disc springs in parallel or series. Therefore, it is possible to properly select conditions on which the load is constant irrespective of the flexure.

Next, by reference to FIGS. 5 to 10, operation of the clamping device having the above structure will be described in detail.

Figure 5:
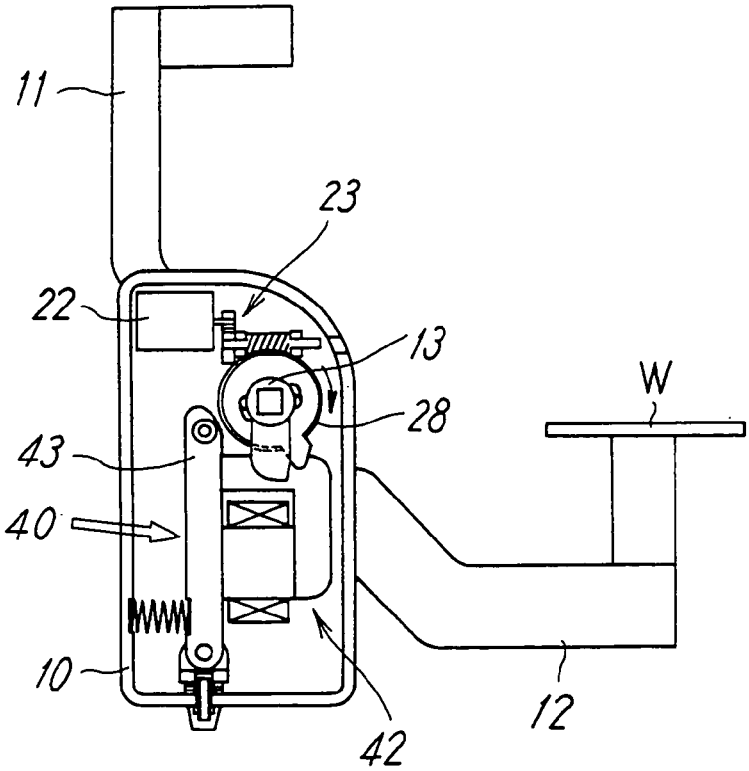
FIG. 5 is an operation explanatory view showing a state in which the worm wheel is in an initial position to start driving in the embodiment.

FIG. 5 shows a state in which the worm wheel 28 is in an initial position to start driving, i.e., the first clamping arm 11 is in the non-clamping position. In this state, if the worm wheel 28 is rotated by the motor 22 via the power transmission mechanism 23, the worm wheel 28 rotates through an angle A from a state shown in FIG. 3*a* to a position shown in FIG. 3*b*. However, during this rotation, the engaging projecting portions 32 on the rotary shaft 13 are only displaced relatively in the recessed grooves 31 and rotation of the motor 22 is not transmitted to the rotary shaft 13.

Figure 6:
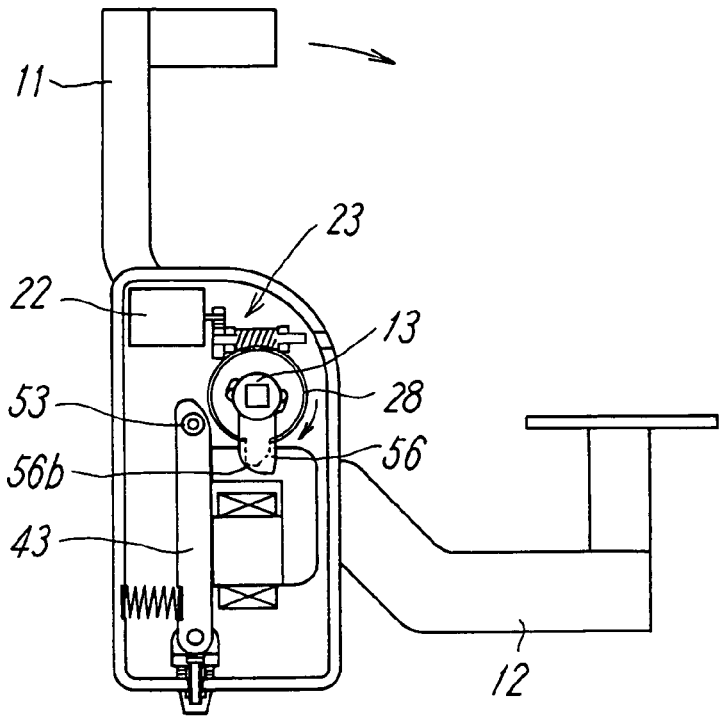
FIG. 6 is an operation explanatory view showing a state in which driving of the first clamping arm in the embodiment starts.

When the worm wheel 28 rotates to the position shown in FIG. 3*b* and an end wall of the recessed grooves 31 is locked to the engaging projecting portions 32, the clamping device is brought into a state shown in FIG. 6. As the motor 22 rotates further from this state, the rotary shaft 13 rotates with the worm wheel 28 and, as a result, the first clamping arm 11 starts rotating.

Figure 7:
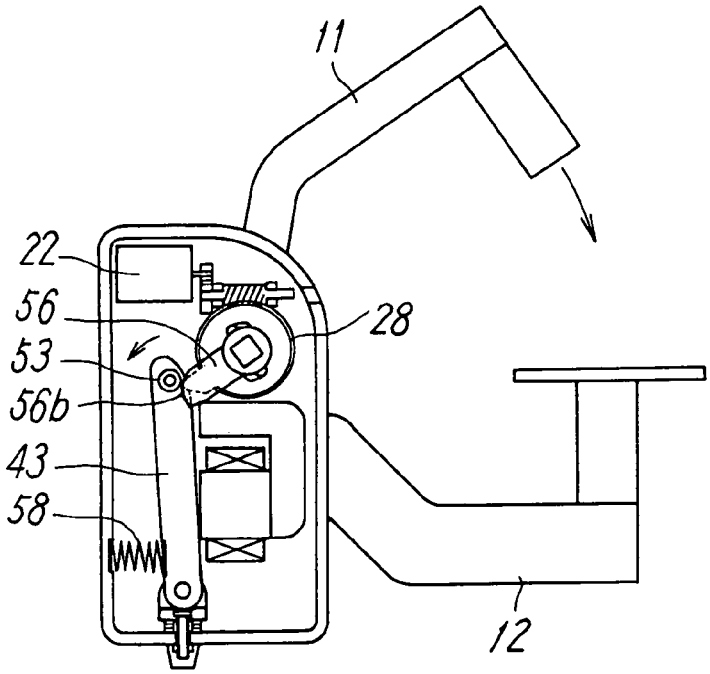
FIG. 7 is an operation explanatory view showing a state in which a pressing member has receded for rotation of a transmitting lever in the embodiment.
Figure 8:
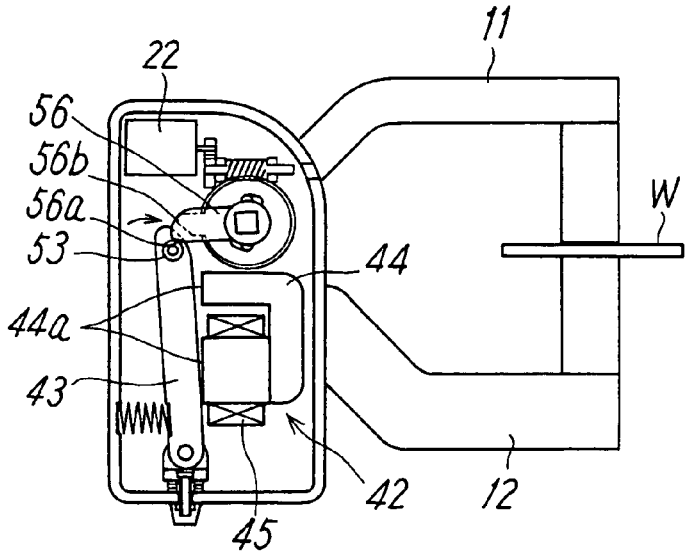
FIG. 8 is an operation explanatory view showing a state in which the first clamping arm is clamping a workpiece but a clamping force is not applied in the embodiment.

When the first clamping arm 11 continues to rotate and the arc-shaped pressing face 56*b* at the tip end of the transmitting lever 56 comes in contact with the roller 53 of the pressing member 43, the pressing member 43 is pressed by the pressing face 56*b* via the roller 53 against the biasing force of the auxiliary spring 58 and is inclined to the left in the drawing as shown in FIG. 7. If the rotary shaft 13 rotates further, the tip end portion of the transmitting lever 56 gets over the roller 53 and moves upward and the first clamping arm 11 reaches the position for clamping the workpiece W as shown in FIG.8. Then, a sensor (not shown) detects that the first clamping arm 11 has reached and energization of the motor 22 is stopped and the exciting coil 45 of the electromagnet 42 is energized based on a detection signal.

Figure 9:
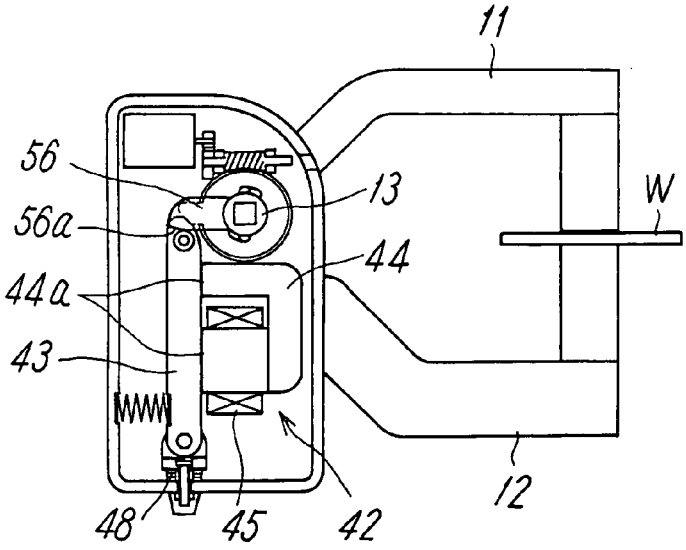
FIG. 9 is an operation explanatory view showing a state in which the clamping force is applied to the clamped workpiece in the embodiment.

If the exciting coil 45 is energized, the pressing member 43 is attracted to the attracting face 44*a* of the core 44 of the electromagnet with a large attracting force. Therefore, the roller 53 of the pressing member 43 comes in contact with the inclined face 56*a* on a lower face of the tip end of the transmitting lever 56 and is pushed into the lower portion of the transmitting lever 56 while pressing the transmitting lever 56 and getting over the inclined face 56*a* to be toggled on as shown in FIG. 9. As a result, the strong clamping force acts on the first clamping arm 11 via the transmitting lever 56 and the rotary shaft 13 by the wedge effect to clamp the workpiece W with the large clamping force.

In this state, the force of the clamping spring 48 is transmitted from the roller 53 to the rotary shaft 13 via the transmitting lever 56 and becomes the clamping force. Therefore, it is possible to stabilize the claming force applied to the workpiece W or to make the clamping force substantially constant.

When the device has come into the state in FIG. 9, the energization of the electromagnet 42 is stopped. In a state in which the pressing member 43 is attracted to the operating position by the electromagnet 42, the pressing member 43 has bumped into the transmitting lever 56 of the rotary shaft 13 at substantially right angle and has been toggled on, this state is retained stably even if energization of the electromagnet 42 is stopped.

To release clamping of the workpiece W from a state in which the first clamping arm 11 is generating the clamping force, the motor 22 is rotated in a reverse direction to the above-described rotation at the start of the clamping to rotate the worm wheel 28 reversely. In this case, as described above by using FIGS. 3*a* and 3*b*, because there is the play in a range of the angle A between each the recessed groove 31 of the worm wheel 28 and each the engaging projecting portion 32 of the rotary shaft 13, the worm wheel 28 starts to rotate prior to the rotary shaft 13 and the clamp releasing lever 29 on the worm wheel 28 presses the pressing face 43*a* at the tip end of the pressing member 43 and inclines the pressing member 43 to cause the roller 53 to recede from the rotating range of the transmitting lever 56 as shown in FIG. 10. As a result, by continuation of rotation of the motor 22, the transmitting lever 56 can rotate to return and the entire device finally returns to an initial position shown in FIG. 5.

Because the clamping device uses separate driving sources for the arm driving portion for rotating and moving the first clamping arm to the clamping position and the clamping force applying portion for generating the required clamping force, it is possible to set the driving forces of the respective driving sources at proper force according to the respective portions.

What is claimed is:

1. A clamping device comprising a first clamping arm and a second clamping arm mounted for opening and closing to a body, an arm driving portion for displacing the first clamping arm to a clamping position and a non-clamping position, and a clamping force applying portion for applying a required clamping force to the clamping arm, wherein the arm driving portion includes a first driving source for displacing the first clamping arm and a power transmission mechanism for transmitting a driving force from the first driving source to a rotary shaft of the first clamping arm, wherein the clamping force applying portion includes a pressing member for applying the clamping force to the first clamping arm by applying a rotating force in a clamping direction to the rotary shaft and a second driving source for displacing the pressing member from a non-operating position to an operating position for applying the clamping force, and wherein the rotary shaft of the first clamping arm has a clamping force transmitting lever and the pressing member presses the transmitting lever to thereby apply the rotating force in the clamping direction to the rotary shaft.

2. A clamping device according to claim 1, wherein a spring force of a clamping spring is applied to the pressing member and the clamping force can be obtained by the spring force.

3. A clamping device according to claim 2, wherein a proximal end portion of the pressing member is rotatably mounted to a bracket, the bracket is mounted to the body with the clamping spring in between, and the spring force of the clamping spring is adjustable.

4. A clamping device according to claim 3, wherein the clamping spring is formed of a disc spring, the disc spring has a region in which the spring force is substantially constant with respect to flexure variation in a characteristic curve, and the spring force in the region is applied as the claming force.

5. A clamping device comprising a first clamping arm and a second clamping arm mounted for opening and closing to a body, an arm driving portion for displacing the first clamping arm to a clamping position and a non-clamping position, and a clamping force applying portion for applying a required clamping force to the clamping arm, wherein the arm driving portion includes a first driving source for displacing the first clamping arm and a power transmission mechanism for transmitting a driving force from the first driving source to a rotary shaft of the first clamping arm, wherein the clamping force applying portion includes a pressing member for applying the clamping force to the first clamping arm by applying a rotating force in a clamping direction to the rotary shaft and a second driving source for displacing the pressing member from a non-operating position to an operating position for applying the clamping force and wherein the second driving source is formed of an electromagnet, the electromagnet has an exciting coil and a core, and the pressing member is displaced to the operating position by an electromagnetic attracting force generated in the core by energization of the exciting coil.

6. A clamping device according to claim 1, wherein the power transmission mechanism and the rotary shaft are connected to each other with play of a certain angle maintained therebetween, the power transmission mechanism has a clamp releasing lever for causing the pressing member to recede from the operating position to the non-operating position, and the clamp releasing lever rotates prior to the rotary shaft in a range of the play in releasing of clamping to thereby cause the pressing member to recede to the non-operating position where the pressing member is detached from the transmitting lever.

7. A clamping device according to claim 6, wherein the power transmission mechanism includes a worm shaft driven by the first driving source and a worm wheel disposed coaxially with the rotary shaft, the worm wheel has the clamp releasing lever and at least one recessed groove in a hole face of a central hole in which the rotary shaft is fitted, an engaging projecting portion provided to an outer periphery of the rotary shaft being fitted in the recessed groove, and a groove width in a circumferential direction of the recessed groove is formed to be larger than a width in the same direction of the engaging projecting portion to thereby form the play.

8. A clamping device according to claim 1, wherein the pressing member has a rotatable roller in a position near a tip end of the member and is in contact with the transmitting lever at substantially right angles via the roller.

9. A clamping device comprising a first clamping arm and a second clamping arm mounted for opening and closing to a body, an arm driving portion for displacing the first clamping arm to a clamping position and a non-clamping position, and a clamping force applying portion for applying a required clamping force to the clamping arm, wherein the arm driving portion includes a first driving source for displacing the first clamping arm and a power transmission mechanism for transmitting a driving force from the first driving source to a rotary shaft of the first clamping arm, wherein the clamping force applying portion includes a pressing member for applying the clamping force to the first clamping arm by applying a rotating force in a clamping direction to the rotary shaft and a second driving source for displacing the pressing member from a non-operating position to an operating position for applying the clamping force and wherein the rotary shaft of the first clamping arm has a clamping force transmitting lever and the pressing member presses the transmitting lever in clamping operation, the pressing member is mounted to the body via a clamping spring to be able to incline and has a rotatable roller near a tip end portion, the roller in contact with the transmitting lever, the power transmission mechanism includes a worm shaft and a worm wheel connected coaxially to the rotary shaft with play of a certain angle in a rotating direction maintained therebetween, the worm wheel has a clamp releasing lever for causing the pressing member to recede from the operating position to the non-operating position, and the play performs a function of rotating the worm wheel prior to the rotary shaft in a range of the play in releasing of clamping to cause the pressing member to recede to a position where the pressing member is detached from the transmitting lever by the clamp releasing lever.

10. A clamping device according to claim 9, wherein the clamping spring is made of a disc spring, the disc spring has a region in which the spring force is substantially constant with respect to flexure variation in a characteristic curve, and the spring force in the region is applied as the clamping force.

11. A clamping device according to claim 9, wherein the first driving source is an electric motor, the second driving source is an electromagnet, the electromagnet has an exciting coil and a core, and the pressing member is displaced to the operating position by an electromagnetic attracting force generated in the core by energization of the exciting coil.

12. A clamping device according to claim 10, wherein the first driving source is an electric motor, the second driving source is an electromagnet, the electromagnet has an exciting coil and a core, and the pressing member is displaced to the operating position by an electromagnetic attracting force generated in the core by energization of the exciting coil.

13. A clamping device according to claim 9, wherein the worm wheel has at least one recessed groove in a hole face of a central hole, an engaging projecting portion provided to an outer periphery of the rotary shaft being fitted in the recessed groove and a groove width in a circumferential direction of the recessed groove is formed to be larger than a width in the same direction of the engaging projecting portion to thereby form the play.

* * * * *